US008033540B2

(12) United States Patent
Lee et al.

(10) Patent No.: US 8,033,540 B2
(45) Date of Patent: Oct. 11, 2011

(54) IMAGE FORMING APPARATUS HAVING PICK-UP ROLLER COVER

(75) Inventors: Jin-soo Lee, Suwon-si (KR); Jae-yong Kim, Suwon-si (KR); Byung-sun Ahn, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 210 days.

(21) Appl. No.: 11/874,457

(22) Filed: Oct. 18, 2007

(65) Prior Publication Data

US 2008/0093789 A1 Apr. 24, 2008

(30) Foreign Application Priority Data

Oct. 20, 2006 (KR) ..... 10-2006-0102436
Jul. 20, 2007 (KR) ..... 10-2007-0073031

(51) Int. Cl.
*B65H 5/26* (2006.01)

(52) U.S. Cl. ..... 271/9.09; 271/145

(58) Field of Classification Search ..... 271/162, 271/145, 9.09; 399/393; 347/104; 221/287; 109/64, 73
See application file for complete search history.

(56) References Cited

U.S. PATENT DOCUMENTS 4,285,510 A * 8/1981 Kanno et al. ..... 271/127
4,429,863 A * 2/1984 Itoh et al. ..... 271/9.09
5,111,252 A * 5/1992 Hamada et al. ..... 399/393
5,145,160 A * 9/1992 Nagashima et al. ..... 271/9.09
5,346,197 A * 9/1994 Takano et al. ..... 271/9.05
5,713,569 A * 2/1998 Girard et al. ..... 271/149
5,957,447 A * 9/1999 Sekine ..... 271/9.09
6,029,970 A * 2/2000 Hwang ..... 271/9.08
6,659,444 B2 * 12/2003 Kawarama ..... 271/9.09
7,036,813 B2 * 5/2006 Asada ..... 271/117
2005/0073087 A1 * 4/2005 Kadowaki et al. ..... 271/118

FOREIGN PATENT DOCUMENTS

CN 1198988 A 11/1998
JP 61188348 A * 8/1986
JP 2005-8362 1/2005
KR 97-49290 8/1997
KR 1998-023204 7/1998
KR 10-0431006 4/2004

OTHER PUBLICATIONS

Office Action issued in Chinese Patent Application No. 200710170200.1 mailed Apr. 3, 2009.

* cited by examiner

*Primary Examiner* — Michael McCullough
(74) *Attorney, Agent, or Firm* — Staas & Halsey LLP

(57) ABSTRACT

An image forming apparatus includes an image forming unit to form an image on a printable medium; a casing to accommodate the image forming unit; a feeding cassette coupled to the casing and arranged so as to move between a feeding position where the feeding cassette is separated from the casing and used to store the printable medium and a waiting position where the feeding cassette is folded up against the casing; a main feeding unit arranged within the casing to store another printable medium and to supply the another printable medium to the image forming unit; a pick-up roller to feed the printable medium from the feeding cassette to the image forming unit when the feeding cassette is in the feeding position; and a pick-up roller cover coupled to a main feeding unit so that the pick-up roller cover can rotate between an open position and a closed position.

21 Claims, 15 Drawing Sheets

1: image forming apparatus
100: feeding unit
110: main feeding unit
150: feeding cassette
170: pick-up roller cover
180: cover rotating switch
120 -> 110

100: feeding unit
150: feeding cassette
170: pick-up roller cover

100: feeding unit
110: main feeding unit
150: feeding cassette
151: feeding cassette main body
152: angle modulating link
152a: link 152b: link guide
155: pressure boss (FIG. 4B)
158: feeding cassette hinge unit 111: main feeding unit casing
115: opening part
150: feeding cassette
151: feeding cassette main body
155: pressure boss
180: cover rotating switch
181: switch main body
183: switch accommodating hole
185: guide groove
500-> 111, 510->115

140 -> 110
173b -> 173
177b -> 177

173: cover rotating shaft
177: guide shaft
180: cover rotating switch
183: switch accommodating hole
185: guide groove 111: main feeding unit casing
170: pick-up roller cover
171: cover main body
177: guide shaft
180: cover rotating switch
181: switch main body
185: guide groove

500 -> 111

111a: main feeding unit casing
140a: sub feeding unit
150a: feeding cassette
151a: feeding cassette main body
153a: feeding cassette rotating shaft
157: coupling shaft
170a: pick-up roller cover
171a: cover main body
173a: cover rotating shaft 140a: sub feeding unit
151a: feeding cassette main body
156: elastic pressure unit
157: coupling shaft
157a: torsion spring
171a: pick-up roller cover main body
173a: cover rotating shaft 111b: main feeding unit casing
140b: sub feeding unit
150b: feeding cassette
151b: feeding cassette main body
153b: feeding cassette rotating shaft
170b: pick-up roller cover
171b: cover main body
173b: inclined surface 111b: main feeding unit casing
115b: opening part
140b: sub feeding unit
150b: feeding cassette
151b: feeding cassette main body
156a: elastic pressure unit
156b: pressure inclined surface
157: coupling shaft
157a: torsion spring
170b: pick-up roller cover
171b: cover main body
173b: inclined surface

| | |
|---|---|
| 10K -> 210K<br><br>190: transferring roller<br>240: transcription belt<br>250: belt driving roller<br>260: transcription roller<br>400: discharging unit | 100: feeding unit<br>110: main feeding unit<br>150: feeding cassette<br>160: pick-up roller<br>170: pick-up roller cover<br>200: image forming unit<br>300: fixing unit<br>500: casing |

IMAGE FORMING APPARATUS HAVING PICK-UP ROLLER COVER

CROSS-REFERENCE TO RELATED APPLICATIONS

This application claims the benefit of Korean Patent Application No. 2006-102436, filed Oct. 20, 2006, and No. 2007-73031, filed Jul. 20, 2007, in the Korean Intellectual Property Office, the disclosures of which are incorporated herein by reference.

BACKGROUND OF THE INVENTION

1. Field of the Invention

Aspects of the present invention relate to an image forming apparatus and, more particularly, to an image forming apparatus having a pick-up roller cover.

2. Related Art

Image forming apparatuses, such as laser printers, photocopiers, facsimile machines, and multi-functional products, are generally connected to a host apparatus in which image data is stored to print the image data onto a printable medium according to an output signal from the host apparatus. The image forming apparatus comprises a feeding unit to store printable media, an image forming unit to form an image onto a printable medium fed from the feeding unit, and a discharging unit to discharge an image-formed printable medium. Image forming apparatuses may be classified into inkjet types, electrophotographic types, and thermal transfer types, depending on how the image forming apparatus forms the image onto the printable medium.

Generally, a feeding cassette is also detachably provided in a casing to stored printable media; and a pick-up roller is arranged to supply the printable media stored in feeding cassette to the image forming unit. In addition, a feeding cassette may be mounted to the casing to store additional printable media.

However, the surface of the conventional pick-up roller is often contaminated by dust from the outside or by paper powder from the inside of the casing since the surface of the conventional pick-up roller is exposed to the outside, even when no printable medium is being fed to the image forming apparatus. If the surface of the pick-up roller is contaminated, the printable media stored in the feeding cassette cannot be supplied with a proper friction force or be fed smoothly.

SUMMARY OF THE INVENTION

Aspects of the present invention provide an image forming apparatus comprising a pick-up roller cover capable of protecting a pick-up roller from being contaminated by the outside.

According to an aspect of the present invention, an image forming apparatus is provided comprising an image forming unit to form an image on a printable medium; a feeding cassette arranged so as to move between a feeding position feeding cassette to store a stack of printable media and a waiting position where the feeding cassette is folded; a pick-up roller to feed an individual sheet of printable medium from the feeding cassette to the image forming unit, when the feeding cassette is in the feeding position; and a pick-up roller cover arranged so as to rotate between an open position to expose the pick-up roller and a closed position to cover the pick-up roller.

According to another aspect of the invention, the pick-up roller cover moves from the closed position to the open position as the feeding cassette moves from the waiting position to the feeding position.

According to another aspect of the invention, the image forming apparatus further comprises a pressing boss provided on one side of the feeding cassette; and a cover rotating switch provided on one side of the casing and interlocked with the pressing boss so as to project and retreat along with a pressing and releasing of the pressing boss and to guide the rotation of the pick-up roller cover between the open position and the closed position when the feeding cassette rotates from the waiting position to the feeding position.

According to another aspect of the invention, the pick up roller cover further comprises a cover main body and a cover hinge unit rotatably coupling the cover main body to the casing.

According to another aspect of the invention, the pick-up roller cover further comprises a guide shaft separated from the cover hinge unit; and the cover rotating switch comprises a guide groove to guide the guide shaft so that the pick-up roller cover can move from the closed position to the open position according to the projection and retreat of the cover rotating switch.

According to another aspect of the invention, the cover hinge unit comprises an elastic member to provide an elastic force to the guide shaft so that the cover rotating switch in the retreated position can be projected with respect to a casing when the cover rotating switch is released from the pressing boss.

According to another aspect of the invention, the image forming apparatus further comprises a pressure boss provided on one side of the feeding cassette to press the pick-up roller cover to as to rotate the pick-up roller cover from the closed position to the open position when the feeding cassette rotates from the waiting position to the feeding position.

According to another aspect of the invention, the image forming apparatus further comprises a hinge unit rotatably supporting the pick-up roller cover and disposed between the pick-up roller cover and the casing.

According to another aspect of the invention, the image forming apparatus further comprises an elastic member arranged at the hinge unit to provide an elastic force so that the pick-up roller cover can rotate to the closed position.

According to another aspect of the invention, the pick-up roller cover comprises a first inclined surface inclined at a predetermined angle in a lower part of the pick-up roller cover, and the pick-up roller cover is coupled to the casing so as to move up or down between the closed position and the open position; and the feeding cassette comprises an ascending and descending link having a second inclined surface corresponding to the first inclined surface, the ascending and descending link rotating with respect to the feeding cassette along with the rotation of the feeding cassette and pressing the pick-up roller cover so that the pick-up roller cover can move up or down.

According to another aspect of the invention, the casing comprises an accommodating unit to accommodate the pick-up roller cover in the open position; and the accommodating unit comprises an ascending and descending guide rail to slidingly guide the pick-up roller cover according to the pressing of the ascending and descending link.

According to another aspect of the invention, a image forming apparatus is provided comprising a casing; an image forming unit inside the casing to forms an image onto a printable medium; a feeding cassette coupled to the casing and arranged so as to rotate between a feeding position to store a stack of printable media and a waiting position where the feeding cassette is folded; a pick-up roller to feed the printable medium from the feeding cassette to the image forming unit; and a pick-up roller cover coupled to the casing to move between an open position to expose the pick-up roller to the outside so as to allow the pick-roller to feed the printable medium from the feeding cassette to the image forming unit and a closed position to cover the pick-up roller so as to prevent contamination of the pick-up roller.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
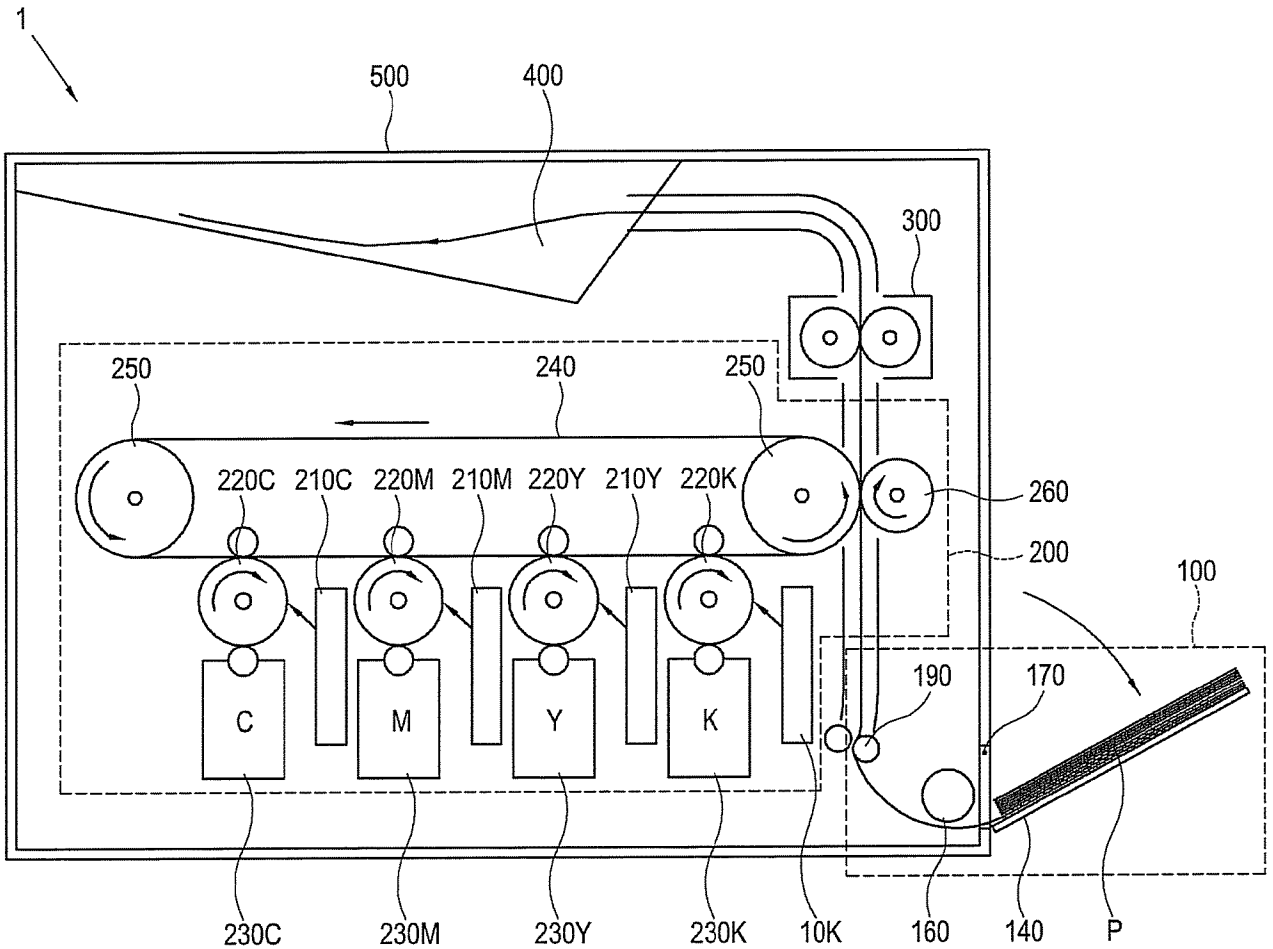
FIG. 1 is a schematic view illustrating a configuration of an image forming apparatus according to an example embodiment of the present invention.

Reference will now be made in detail to the present embodiments of the present invention, examples of which are illustrated in the accompanying drawings, wherein like reference numerals refer to like elements throughout. The embodiments are described below in order to explain the present invention by referring to the figures.

Figure 9:
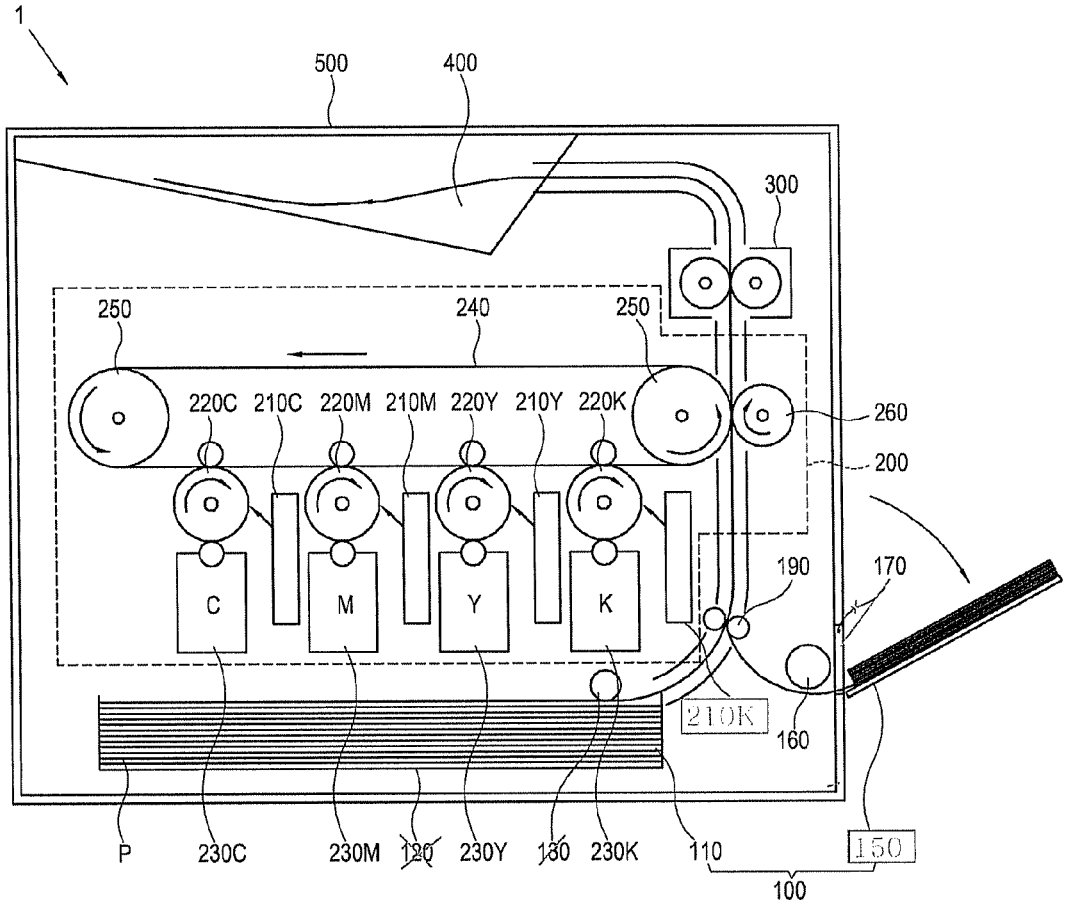
FIG. 9 is a schematic view illustrating a configuration of an image forming apparatus according to another exemplary embodiment of the present invention.

As shown in FIG. 9, an image forming apparatus 1 comprises a feeding unit 100 to supply a printable medium to an image forming unit 200 to form an image onto the printable medium fed from the feeding unit 100, a fixing unit 300 to fix the image onto the printable medium P on which the image is formed in the image forming unit 200, a discharging unit 400 to discharge the image-formed printable medium P to the outside, and a casing 500 accommodating these components. Image forming apparatuses according to other aspects of the present invention may include these and/or other components. Such an image forming apparatus 1 may be a printer, facsimile machine, photocopier, or multi-functional product. Similarly, the printable medium P may be any medium capable of having an image formed thereon, such as paper, cardboard, or film.

The feeding unit 100 comprises a main feeding unit 110 detachably mounted to the casing 500, a feeding cassette 150 coupled to the casing 500 to store printable media and arranged so as to rotate, and a transferring roller 190 to transfer to the image forming unit 200 the printable media that are picked up by the feeding unit 100. In this case, a user can select either of the main feeding unit 110 or the feeding cassette 150. If the main feeding unit 110 is selected, a pick-up roller cover 170 maintains a closed state, thereby preventing a pick-up roller 160 from contamination.

Figure 2:
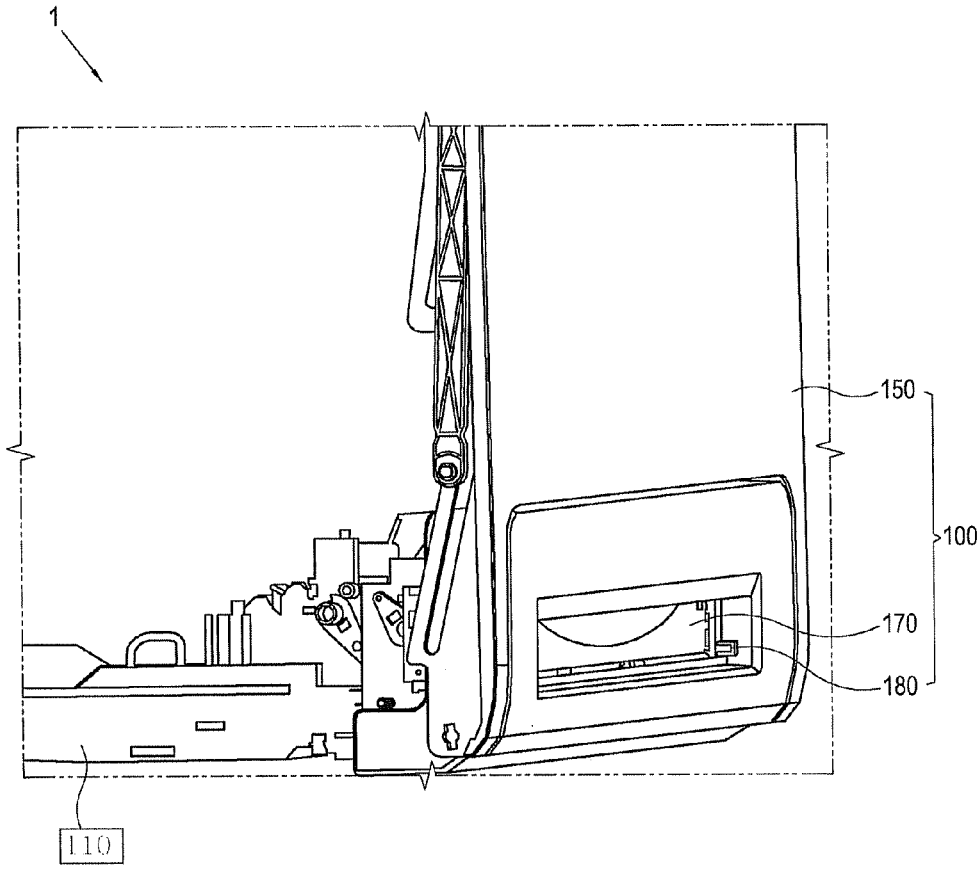
FIG. 2 is a perspective view illustrating a configuration of a feeding unit according to an example embodiment of the present invention.

FIGS. 2 through 5B illustrate a configuration of the feeding unit 100 according to an example embodiment of the present invention. As shown in FIG. 2 and FIG. 3A, the feeding unit 100 comprises the feeding cassette 150, the pick-up roller 160, the pick-up roller cover 170, and a cover rotating switch 180. The feeding cassette 150 which is coupled to the casing 500 and arranged to rotate between a waiting position where the feeding cassette 150 is folded up against the casing 500, as shown in FIG. 2, and a feeding position where the feeding cassette 150 is opened from the casing 500 to supply the printable medium P to the pick-up roller 160, as shown in FIG. 4A. The pick-up roller 160, as shown in FIG. 1, picks up the printable medium P from the feeding cassette 150 to the image forming unit 200 while the feeding cassette 150 is in the feeding position. The pick-up roller cover 170 rotates with the rotation of the feeding cassette 150 between the waiting position and the feeding position. The pick-up roller cover 170 is coupled to the casing 500 so as to rotate between an open position, as shown in FIG. 4A, to expose the pick-up roller 160 to the outside and a closed position, as shown in FIG. 2, to cover the pick-up roller 160. The cover rotating switch 180 is provided on one side of the pick-up roller cover 170 and converts the rotation of the feeding cassette 150 into the rotation of the pick-up roller cover 170 so as to open and close the pick-up roller cover 170.

Figure 4A:
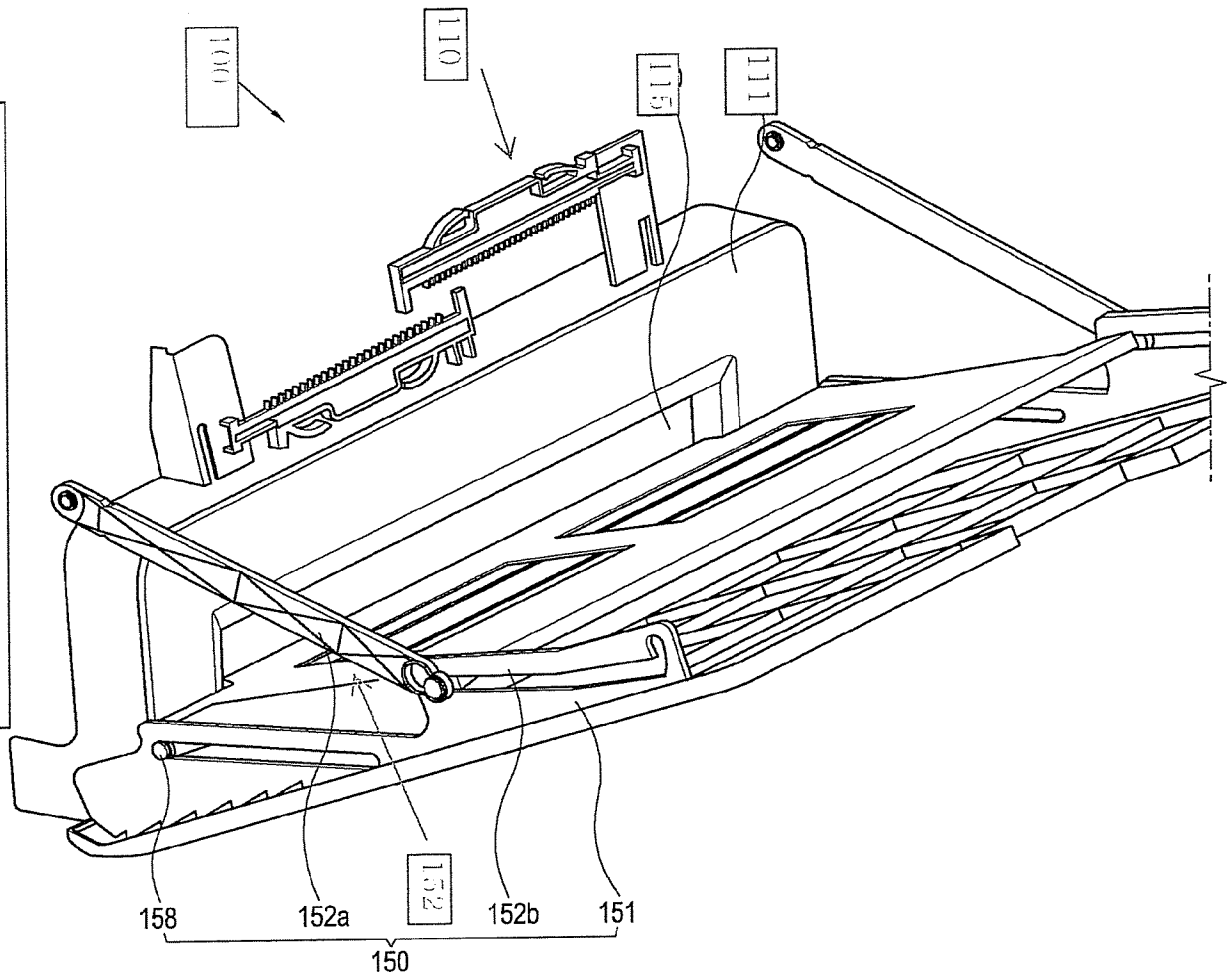
FIG. 4A is a perspective view illustrating a configuration of a feeding position of a feeding cassette according to an example embodiment of the present invention.
Figure 4B:
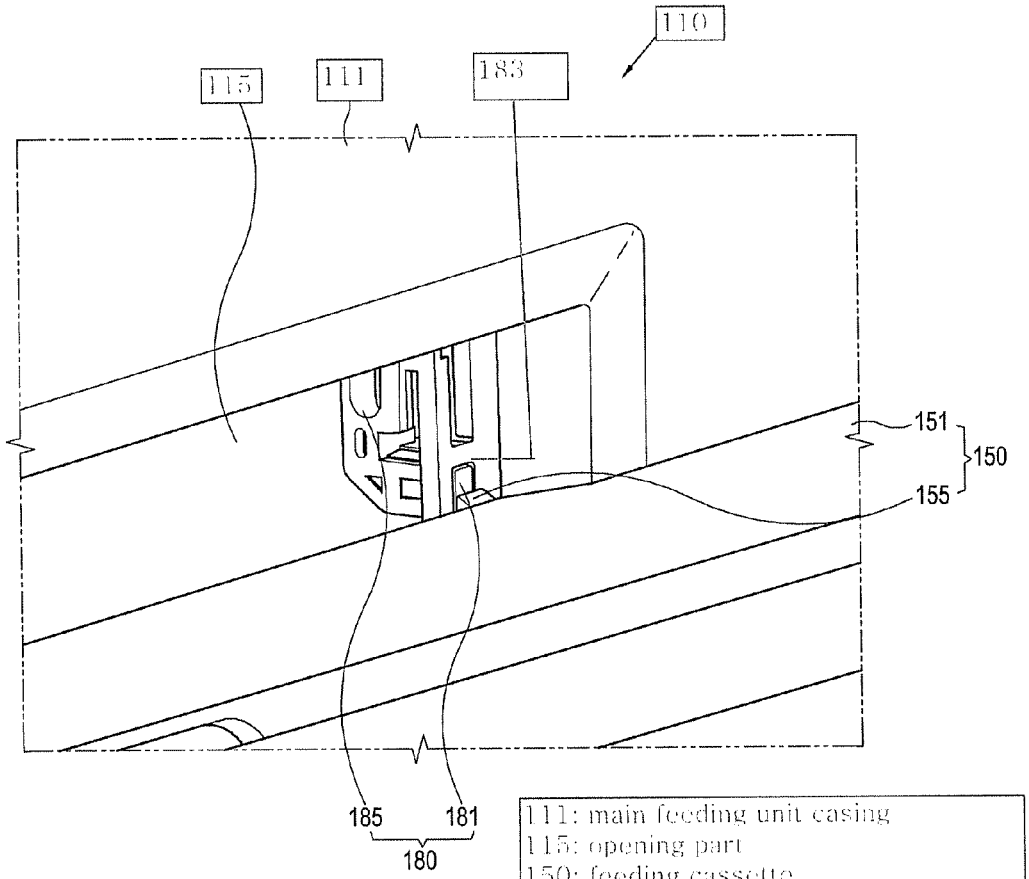
FIG. 4B is a perspective view enlargedly illustrating a configuration of the feeding cassette and the cover rotating switch shown in FIG. 4A.
Figure 4C:
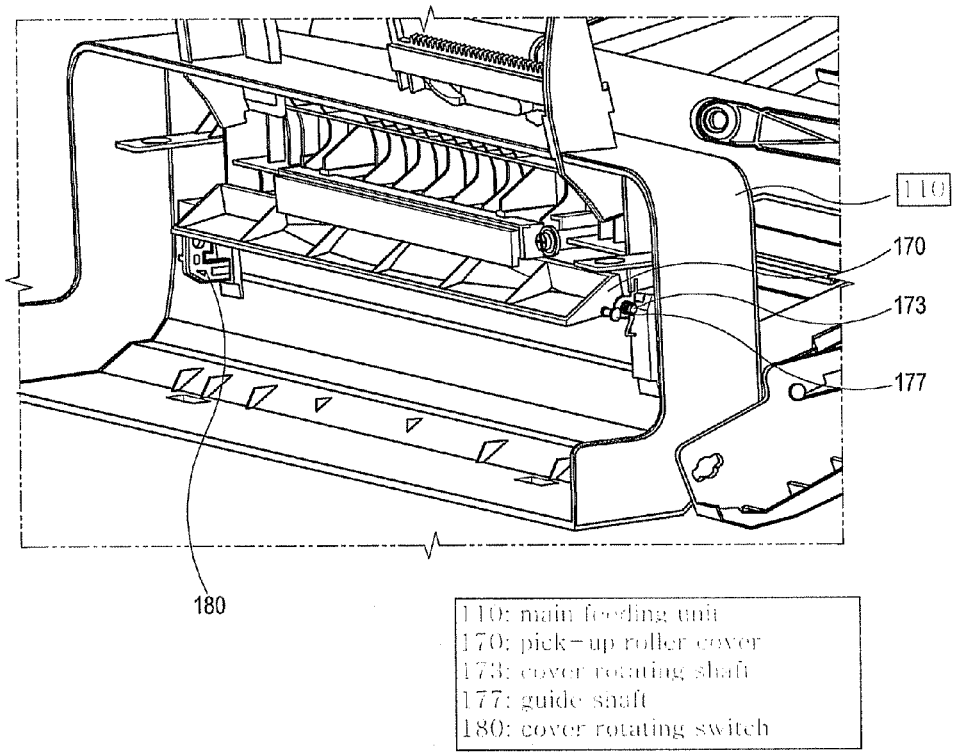
FIG. 4C is a rear perspective view illustrating a rear configuration of the feeding cassette cover in 4A.

As shown in FIGS. 4A and 4B, the feeding cassette 150 comprises a feeding cassette main body 151, a feeding cassette hinge unit 158, a pressure boss 155, and an angle modulating link 152. The feeding cassette main body 151 is rotatably coupled to the casing 500 (See FIG. 1). The feeding cassette hinge unit 158 rotatably couples the feeding cassette main body 151 to the casing 500. The pressure boss 155, as shown in FIG. 4B, is provided on one side of the feeding cassette main body 151 to push the cover rotating switch 180 when the feeding cassette main body 151 rotates. The angle modulating link 152 is provided on one side of the feeding cassette main body 151 to modulate a rotation angle of the feeding cassette main body 151.

The feeding cassette main body 151 is provided as a plate member having a predetermined area so as to cover a predetermined area of one side of the casing 500. The feeding cassette main body 151 may have a plurality of plate members coupled together so as to extend a storing area according to the size of the stored printable medium P. A guide member (not shown) may be provided in the feeding cassette main body 151 to guide the printable medium P according to the width of the printable medium P.

A coupling device (not shown) may be provided on one side of the feeding cassette main body 151 to fixedly couple the feeding cassette 150 to the casing 500 when the feeding cassette 150 is in the waiting position. In general, a hook may be used for the coupling device. The hook may be coupled to a hook accommodating unit (not shown) provided in the casing 500 to maintain the feeding cassette in the waiting position. Other aspects of the present invention may have different types of coupling devices, such as an adhesive surface.

As shown in FIG. 4B, the pressure boss 155 is arranged in a position corresponding to the cover rotating switch 180 when the feeding cassette main body 151 is in the feeding position. The pressure boss 155 projects from the planar surface of the feeding cassette main body 151 toward the pick-up roller cover 170. The length of the pressure boss 155 may be the shortest length such that the cover rotating switch 180 can rotate the pick-up roller cover 170, in order to reduce interruption when the feeding cassette main body 151 rotates. The pressure boss 155 may be provided separately from the feeding cassette main body 151 and may be coupled to the feeding cassette main body 151 by a gluing coupling method or other coupling methods. The pressure boss may also be integrated into the feeding cassette main body 151.

As shown in FIG. 4A, the angle modulating link 152 comprises a link guide 152*b* and a link 152*a*. The link guide 152*b* is arranged on opposite sides of the feeding cassette main body 151. The link 152*a* moves along the link guide 152*b*. The link 152*a* is positioned in an upper part of the link guide 152*b* when the feeding cassette main body 151 is in the waiting position. The link 152*a* moves along the link guide 152*b* while the feeding cassette main body 151 is rotating from the waiting position to the feeding position and vice versa. The link 152*a* is disposed in a lowest end part of the link guide 152*b* when the feeding cassette main body 151 is in the feeding position. A rotating angle of the feeding cassette 151 in the feeding position can be modulated according to the length of the link guide 152*b*.

The pick-up roller 160 is in contact with the printable medium P stored in the feeding cassette 150 and picks up the printable medium P feeding cassette to the image forming unit 200. The pick-up roller 160 rotates in contact with the printable medium P and picks up the printable medium P using a friction force.

Figure 3A:
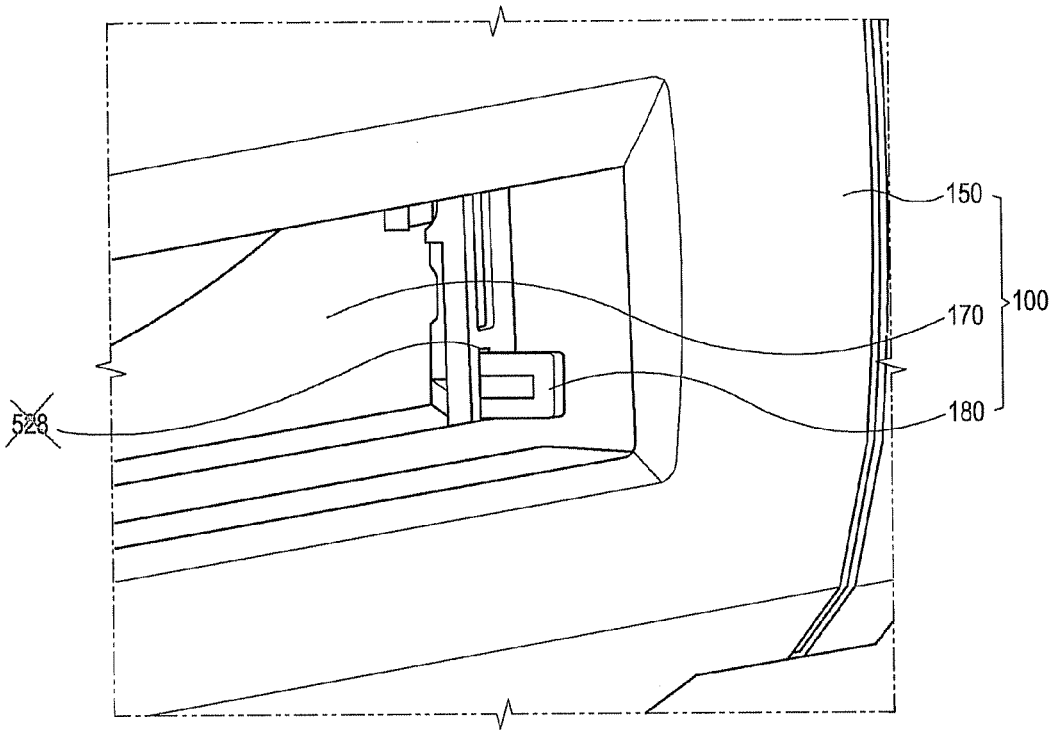
FIG. 3A is a detailed view illustrating a configuration of a pick-up roller feeding unit shown in FIG. 2.
Figure 3B:
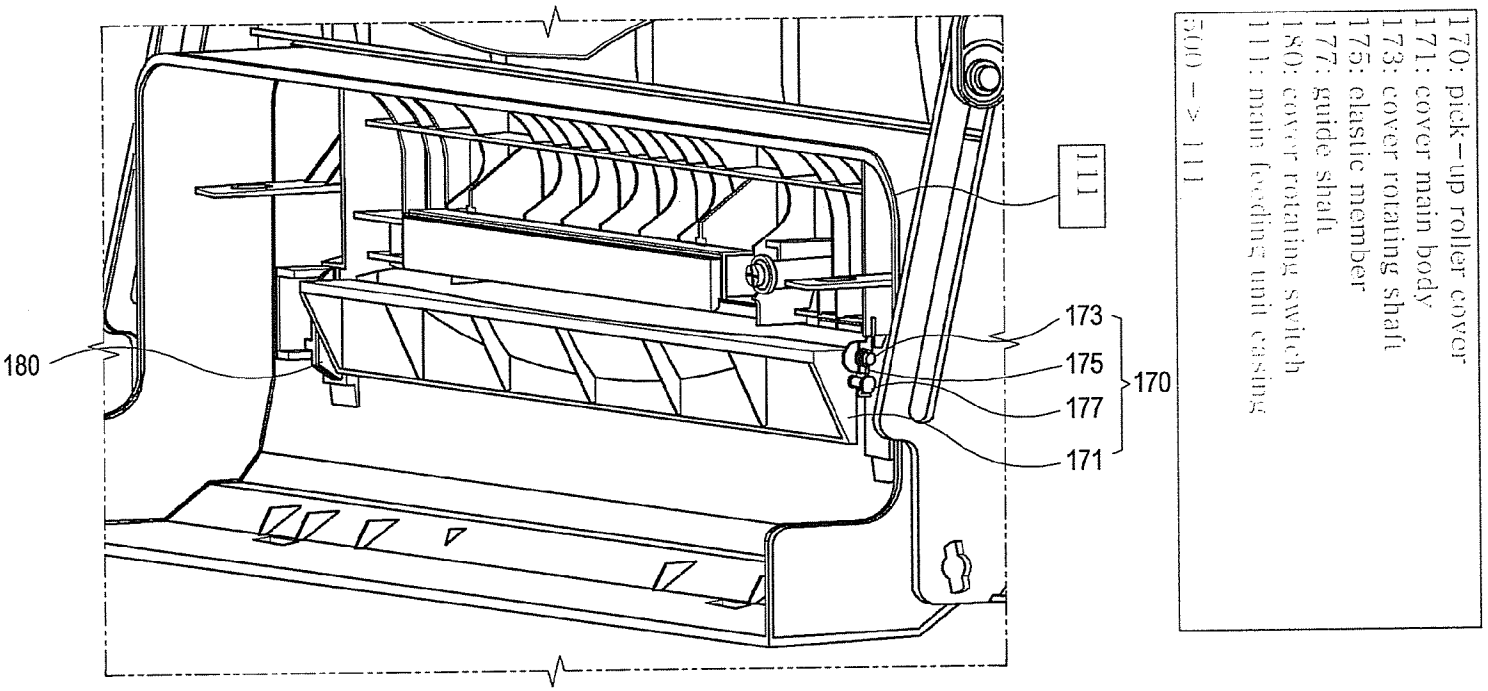
FIG. 3B is a rear perspective view enlargedly illustrating a rear configuration of the pick-up roller cover shown in FIG. 2 when a cover main body is closed.

As shown in FIGS. 3A-3B, the main feeding unit 110 includes a main feeding unit casing 111 having an opening part 115. The pick-up roller cover 170 is rotatably coupled to the opening part 115 of the main feeding unit casing 111 through which the printable medium P is transferred. The pick-up roller cover 170 interlocks with the cover rotating switch 180 and exposes or covers the pick-up roller 160 with respect to the outside when the cover rotating switch 180 is projected or retreated, respectively. The pick-up roller cover 170 comprises a cover main body 171, a cover rotating shaft 173, a guide shaft 177, and an elastic member 175. The cover rotating shaft 173 supports the cover main body 171 so as to allow the cover main body 171 to rotate with respect to the main feeding unit casing 111. The guide shaft 177 is coupled to the cover rotating switch 180 and converts a projecting and a retreating movement of the cover rotating switch 180 into the rotation of the pick-up roller cover 170 between the open position and the closed position. The elastic member 175 is provided in the cover rotating shaft 173 and enables the cover main body 171 to rotate from the open position to the closed position.

Figure 6:
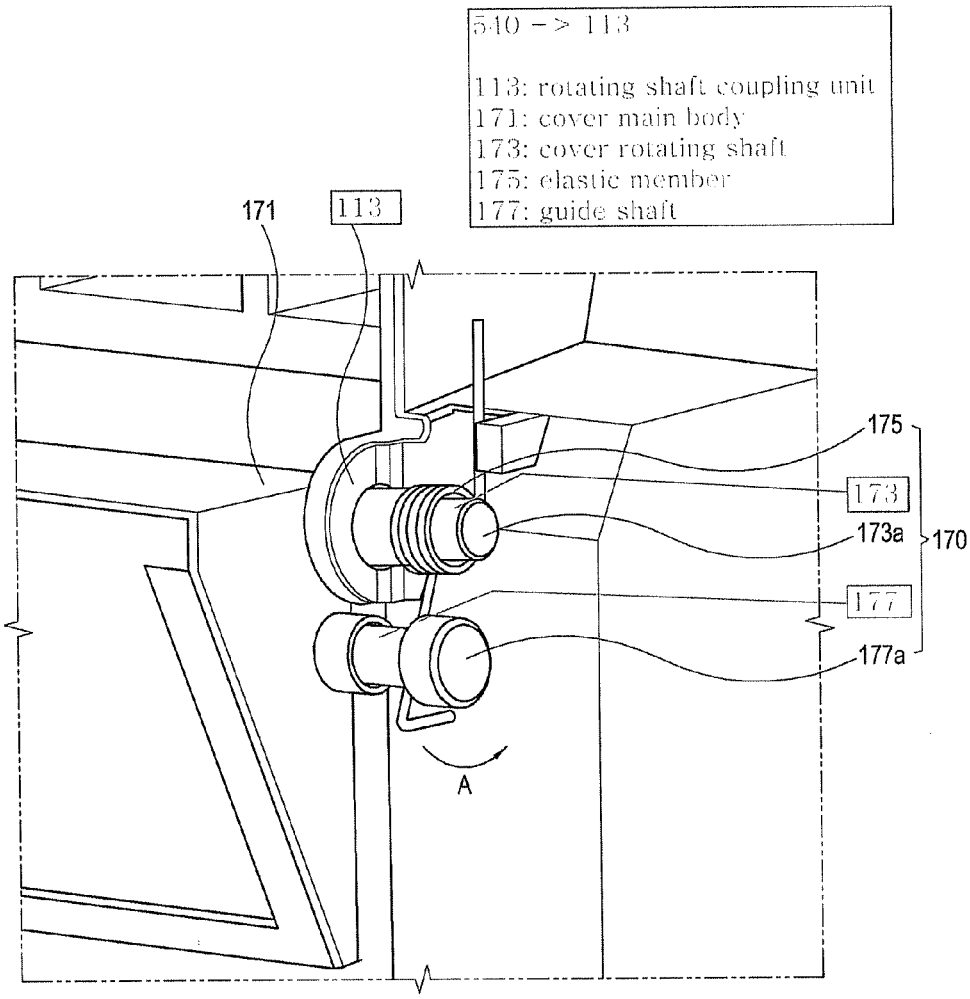
FIG. 6 is a perspective view illustrating a configuration of a cover rotating shaft of the pick-up roller cover according to an example embodiment of the present invention.

The size of the cover main body 171 corresponds to the size of the opening part 115 formed in the main feeding unit casing 111, as shown in FIGS. 4A and 4B. The cover main body 171 may have a thickness so as to be able to rotate between the open position and the closed position easily while interlocking with the projection and the retreat of the cover rotating switch 180. The cover rotating shaft 173 is provided on opposite sides of the upper area of the cover main body 171. One end part 173*a* of the cover rotating shaft 173, as shown in FIG. 6, is rotatably accommodated in a rotating shaft coupling unit 113 of the main feeding unit casing 111. An opposite end part (not shown) is coupled to the cover rotating switch 180. As shown in FIG. 6, the elastic member 175 is provided in one end part 173*a* of the cover rotating shaft 173 to apply an elastic force in a direction A so that the cover main body 171 can rotate from the open position to the closed position. The elastic member 175 may be provided as a torsion spring to supply an elastic force to the direction where the cover main body 171 is maintained in the closed position. However, other devices may be employed as the elastic member 175 to provide the elastic force.

Figure 5A:
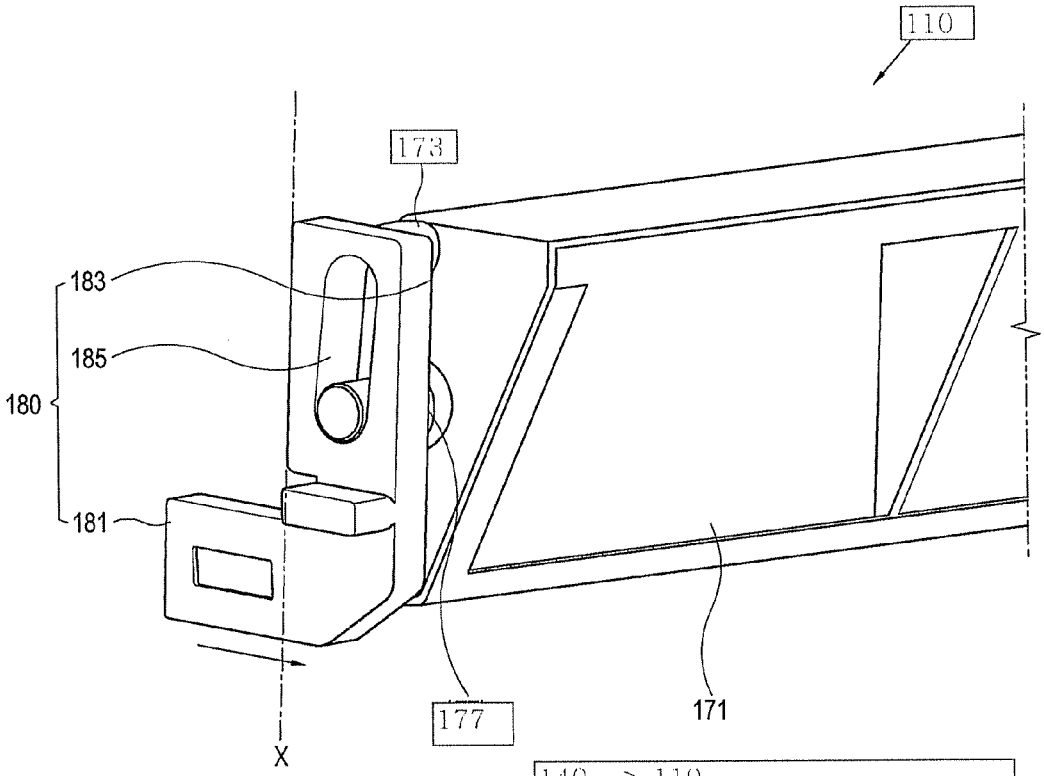
FIGS. 5A and 5B are perspective views illustrating a configuration of the pick-up roller cover and the cover rotating switch in a waiting position and a feeding position, respectively, according to an example embodiment of the present invention.
Figure 5B:
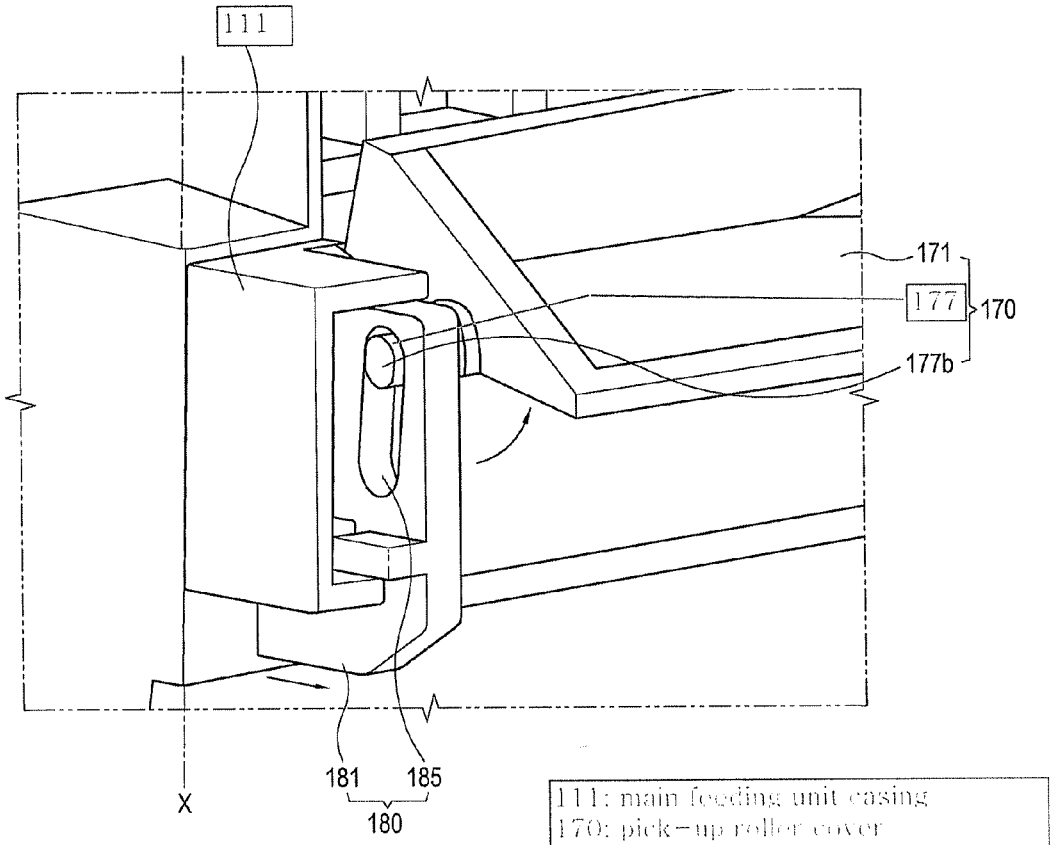

The guide shaft 177 is separate from the cover rotating shaft 173. As shown in FIG. 5B, one end part 177*b* of the guide shaft 177 is accommodated in a guide groove 185 of the cover rotating switch 180. The guide shaft 177 moves up and down along the guide groove 185 along with the projection and the retreat of the cover rotating switch 180. As shown in FIG. 5A, the guide shaft 177 is disposed in a lower end part of the guide groove 185 and enables the cover main body 171 to be maintained in the closed position when the cover rotating switch 180 is in the projected position with respect to the main feeding unit casing 111. As shown in FIG. 5B, the guide shaft 177 moves upward along the guide groove 185 when the cover rotating switch 180 is projected with respect to the main feeding unit casing 111 and moves downward along the guide groove 185 when the cover rotating switch 180 is retreated with respect to the casing 500. The cover main body 171 opens according to the movement of the guide shaft 177.

The cover rotating switch 180 comprises a switch main body 181, a cover rotating shaft coupling unit (not shown), and the guide groove 185. The switch main body 181 projects and retreats with respect to the main feeding unit casing 111 based on the rotation of the feeding cassette 150. The cover rotating shaft coupling unit is provided on one side of the switch main body 181 and rotatably supports the cover rotating shaft 173. The guide groove 185 guides the guide shaft 177*b*.

The switch main body 181 enables the pick-up roller cover 170 to rotate between the open position and the closed position. The switch main body 181 is projected with respect to the main feeding unit casing 111 when the feeding cassette 150 is in the waiting position and is pushed by the pressure boss 155 to be retreated with respect to the main feeding unit casing 111 when the feeding cassette 150 is in the feeding position.

The guide groove 185 is formed through one area of the switch main body 181 to movably accommodate the motion of the guide shaft 177. The guide groove 185 may have a length such that that the cover main body 171 can open the opening part 115 according to the upward rotation of the guide shaft 177.

Returning to FIG. 1, the transferring roller 190 transfers to the image forming unit 200 the printing medium that is picked up from either the main feeding unit 110 or the feeding cassette 154. A plurality of the transferring rollers 190 may be provided based on the length and the shape of a transferring route from the main feeding unit 110 (or the feeding cassette 154) to the image forming unit 200.

The image forming unit 200 forms an image on the printable medium P transferred through the transferring roller 190. The image forming unit 200 may have a plurality of photosensitive drums 220C, 220M, 220Y, and 220K; exposure units 210C, 210M, 210Y, and 210K; and developing units 230C, 230M, 230Y, and 230K, all corresponding to toner of cyan (C), magenta (M), yellow (Y), and black (K). A transcription belt 240 is disposed adjacent to each of the photosensitive drums 220C, 220M, 220Y, and 220K. A belt driving roller 250 is provided in the photosensitive drums 220C, 220M, 220Y, and 220K to transfer the transcription belt 240 at a uniform speed. A transcription roller 260 is in contact with the transcription belt 240 across the printable medium to transcribe the developer on the transcription belt 240 onto the printable medium. The fixing unit 300 fixes the transcribed image onto the printable medium P by heat and pressure. The image forming unit 200 and the fixing unit 300 may be configured in any fashion, depending on the particular image forming apparatus.

The discharging unit 400 discharges the printable medium P on which the image is fixed through the fixing unit 300. The printable medium P is discharged through a discharging hole (not shown) provided on an upper side of the casing 500 and is stored in the discharging unit 400.

A direction changing unit (not shown) may be further provided between the fixing unit 300 and the discharging unit 400 to change a transferring direction of the printable medium P to form an image on another side of the printable medium P. The printable medium P may be re-transferred to the image forming unit 200 by a duplex roller (not shown).

The casing 500 accommodates the above-described components and protects them from outside impact or outside contamination.

The opening part 115 is formed in the main feeding unit casing 111 and transfers the printable medium P transferred from the feeding cassette 150 to the outside. The opening part 115 may have a width corresponding to the maximum width of the printable media stored in the feeding cassette 150. The opening part 115 may be provided to have a height corresponding to the volume of the printable media stored in the feeding cassette 150 so that the pick-up roller 160 can pick up a printable medium P at the top of the pile.

A switch accommodating hole 183 is formed on one side of the opening part 115 and accommodates the switch main body 181 so that the cover rotating switch 180 can be projected and retreated, and the discharging hole through which the printable medium P image-formed in the fixing unit 300 is discharged. The switch accommodating hole 183 may be larger than a cross-section of the switch main body 181 so that the switch main body 181 can easily project and retreat.

An image forming routine of the image forming apparatus 1 with this configuration according to an example embodiment will be described with reference to FIGS. 1 through 6. First, when a user separates the feeding cassette 150 coupled to the casing 500 in the waiting position from the casing 500, the link 152*a* moves along the link guide unit 152*b* and the feeding cassette 150 rotates. In response to the rotation of the feeding cassette 150, the pressure boss 155 feeding cassette pushes the switch main body 181, as shown in FIG. 4B. The switch main body 181 retreats with respect to the casing 500 due to the pressure from the pressure boss 155, as shown in FIG. 5B.

The motion of the switch main body 181 causes the guide shaft 177*b* to rotate upward along the guide groove 185 in the retreating direction of the switch main body 181. The cover main body 171 rotates with respect to the cover rotating shaft 173 to the open position, exposing the pick-up roller 160 to the outside through the opening 115 to contact the printable medium P stored in the feeding cassette 150. The pick-up roller 160 rotates according to an output signal by the user and supplies a friction force to the top printable medium P stored in the feeding cassette 150 to pick up the top printable medium P. The picked-up printable medium P is transferred through the transferring roller 190.

The image forming unit 200 sprays developer on the printable medium P to form an image thereon. The fixing unit 300 fixes the developer onto the printable medium P by heat and pressure. The image-fixed printable medium P is discharged through the discharging unit 400.

According to an example embodiment of the present invention, the image forming apparatus 1 can be kept clean for a long time, since the pick-up roller 160 of the main feeding unit 110 is protected from outside contamination. The pick-up roller cover 170 moves with the rotation of the feeding cassette 150 by the cover rotating switch 180 so that the feeding cassette 150 can be used without an additional opening/closing unit.

Figure 7A:
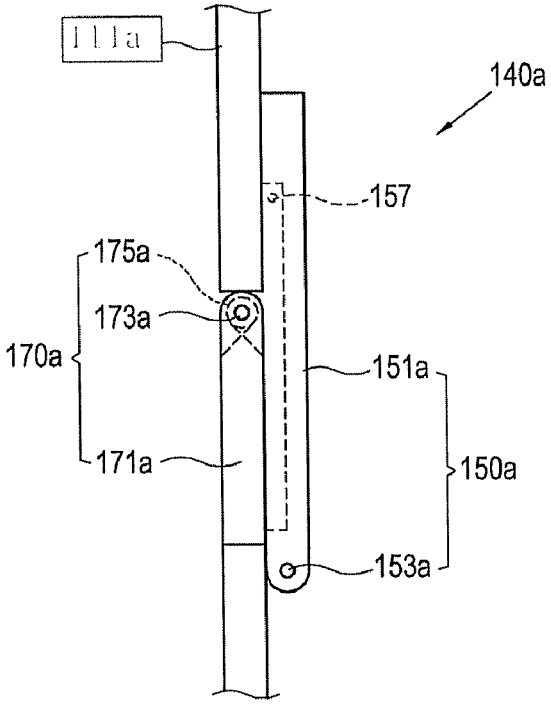
FIGS. 7A and 7B are schematic views illustrating a configuration of the sub feeding unit according to another example embodiment of the present invention.
Figure 7B:
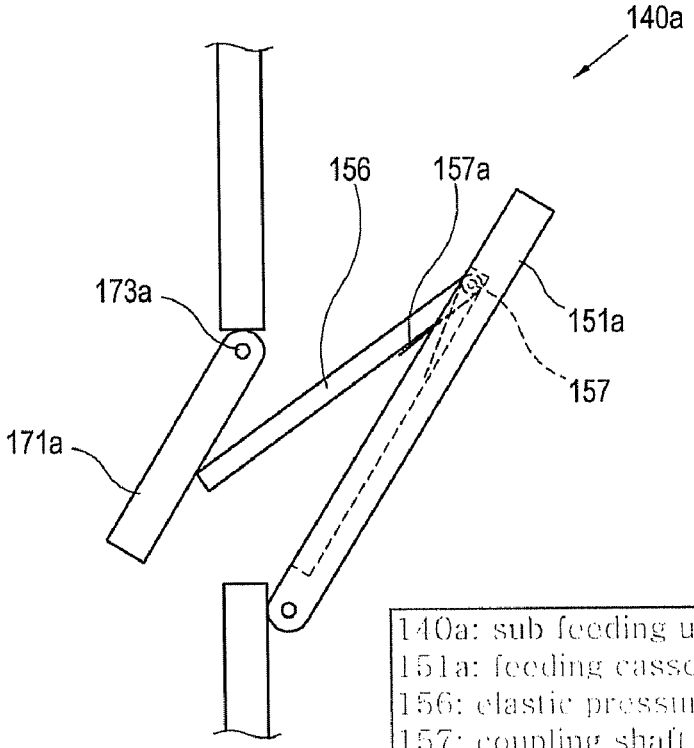

FIGS. 7A and 7B are schematic views illustrating a configuration of a sub feeding unit 140*a* according to another example embodiment of the present invention. The sub feeding unit 140*a* comprises a pick-up roller cover 170*a* rotatably coupled to a main feeding unit casing 111*a* and a feeding cassette 150*a* pick-up roller.

The pick-up roller cover 170*a* comprises a cover main body 171*a* and the cover rotating shaft 173*a* rotatably supporting the cover main body 171*a*. The feeding cassette 150*a* comprises the feeding cassette main body 151*a*, a feeding cassette rotating shaft 153*a*, and an elastic pressure unit 156 (shown in FIG. 7B) provided on opposite ends of the feeding cassette main body 151*a*. The elastic pressure unit 156 rotates elastically according to the rotation of the feeding cassette main body 151*a* and pushes the pick-up roller cover 170*a*.

The elastic pressure unit 156 comprises the coupling shaft 157 rotatably coupled to the feeding cassette main body 151*a*, and a torsion spring 157*a* provided on the coupling shaft 157 to supply the elastic force to the coupling shaft 157 so that the elastic pressure unit 156 can rotate to push the pick-up roller cover 170*a* when the feeding cassette 150*a* rotates.

A feeding process of the sub feeding unit 140*a* according to the example embodiment described in connection with FIG. 7A and FIG. 7B will be described as follows. First, when the user separates the feeding cassette 150*a* from the casing 500, the elastic pressure unit 156 rotates due to the elastic force of the torsion spring 157*a*. Accordingly, the elastic pressure unit 156 pushes the pick-up roller cover main body 171*a*, and causes the pick-up roller cover main body 171*a* to open.

The sub feeding unit 140*a* according to the example embodiment described in connection with FIG. 7A and FIG. 7B may have a simpler configuration than that of the example embodiment described in connection with FIGS. 2-6 and 9, since the elastic pressure unit 156 pushes the pick-up roller cover 170*a* open directly according to the rotation of the feeding cassette 150*a*.

Figure 8A:
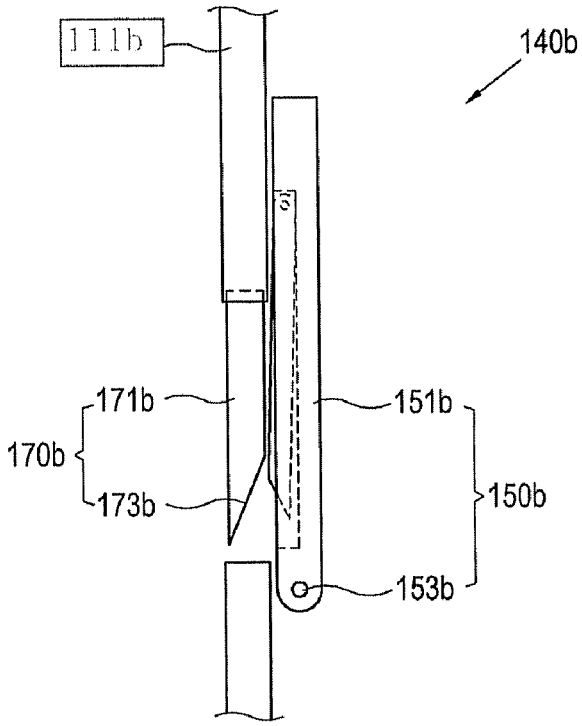
FIGS. 8A and 8B are schematic views illustrating a configuration of the sub feeding unit according to still another example embodiment of the present invention.
Figure 8B:
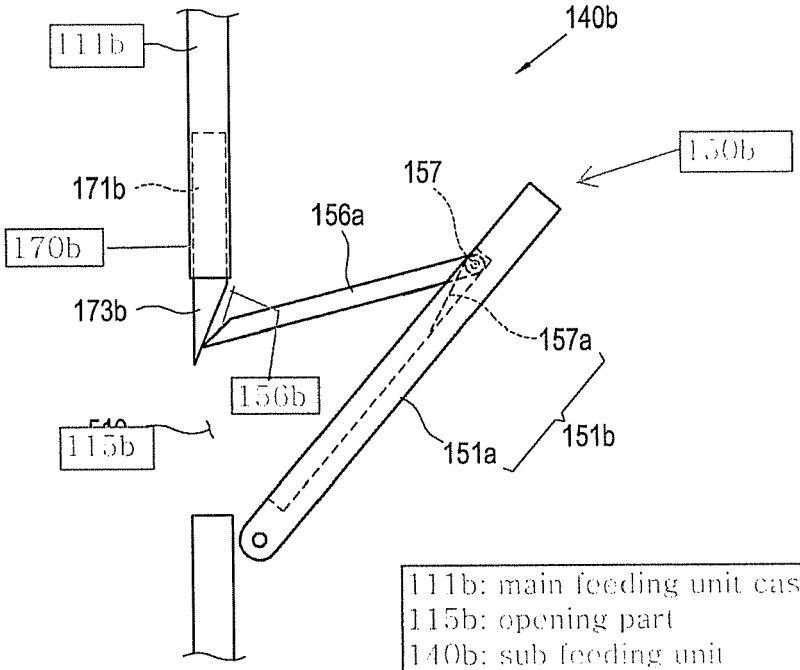

FIGS. 8A and 8B are schematic views illustrating a sub feeding unit 140*b* according to still another example embodiment of the present invention. The sub feeding unit 140*b* comprises a pick-up roller cover 170*b* coupled to a main feeding unit casing 111*b* so as to move up or down and a feeding cassette 150*b* having the elastic pressure unit 156*a* to move the pick-up roller cover 170*b* upward.

The pick-up roller cover 170*b* comprises a cover main body 171*b* having a predetermined inclined surface 173*b*. A rail coupling unit (not shown) may be provided on opposite sides of the cover main body 171*b*. The rail coupling unit may be coupled to a guide rail (not shown) that is provided on an internal wall of the main feeding unit casing 111*b* when the cover main body 171*b* moves up or down.

The feeding cassette 150*b* comprises a feeding cassette main body 151*b*, a feeding cassette rotating shaft 153*b*, and the elastic pressure unit 156*a*. The elastic pressure unit 156*a* is arranged on opposite end parts of the feeding cassette main body 151*b* and is elastically rotated according to the rotation of the feeding cassette main body 151*b* to push the pick-up roller cover 170*b*. The elastic pressure unit 156*a* comprises the coupling shaft 157 feeding cassette and the torsion spring 157*a*. The coupling shaft 157 is rotatably coupled to the feeding cassette main body 151*b* and the torsion spring 157*a* is provided on the coupling shaft 157. The torsion spring 157*a* supplies an elastic force to the coupling shaft 157 so that the elastic pressure unit 156*a* can elastically rotate and push the pick-up roller cover 170*b* when the feeding cassette 150*a* rotates. A pressure inclined surface 156*b* is provided in a lower end area of the elastic pressure unit 156*a* corresponding to the shape of the inclined surface 173*b* of the pick-up roller cover main body 171*b*.

A feeding process of the sub feeding unit 140*b* according to the example embodiment described in connection with FIG. 8A and FIG. 8B will be described as follows. First, when the user separates the feeding cassette 150*b* from the main feeding unit casing 111*b*, the elastic pressure unit 156*a* is rotated by the elastic force of the torsion spring 157*a*. Accordingly, the pressure inclined surface 156*b* of the elastic pressure unit 156*a* pushes the inclined surface 173*b* of the cover main body 171*b*. The cover main body 171*b* moves upward inside the main feeding unit casing 111*b* to open an opening part 115*b*.

The sub feeding unit 140*b* according to the example embodiment described in connection with FIG. 8A and FIG. 8B can be easily operated without an additional opening/closing unit since the pick-up roller cover 170*b* moves upwardly or downwardly inside the casing 500 along the shape of the inclined surface 173*b* formed in the pick-up roller cover 170*b*.

The image forming unit 200 according to an example embodiment of the present invention may employ a multi-pass type having four color developers and four exposure parts. The image forming unit 200 may also employ a single-pass type having four color developers and one exposure unit or a mono type using one color (black) developer to form an image.

As described above, the image forming apparatus according to aspects of the present invention comprises the pick-up roller cover to expose and cover the pick-up roller with respect to the outside so that the pick-up roller can be used cleanly for a long time. In addition, a smooth feeding of the sub feeding unit can be performed.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, the image forming unit may form an image onto the printable medium P using the inkjet technique, the electrophotographic technique, or the thermal transfer technique. Similarly, the feeding cassette may be designed so as to omit some of the components described with respect to the example embodiments shown in the figures, such as all or a portion of the various shafts. Accordingly, it is intended, therefore, that the present invention not be limited to the various example embodiments disclosed, but that the present invention includes all embodiments falling within the scope of the appended claims.

What is claimed is:

1. An image forming apparatus comprising:

a casing;

an image forming unit within the casing to form an image on a printable medium;

a feeding cassette arranged so as to rotate between a feeding position, opened outward with respect to the casing, to store a stack of printable media and a waiting position where the feeding cassette is folded adjacent to the casing;

a pick-up roller to feed an individual sheet of printable medium from the feeding cassette to the image forming unit, when the feeding cassette is in the feeding position;

a pick-up roller cover arranged so as to rotate between an open position, opened inward with respect to the casing, to expose the pick-up roller and a closed position, adjacent to the casing, to cover the pick-up roller; and a connector to connect the pick-up roller cover to the feeding cassette, wherein the pick-up roller cover moves from the closed position to the open position as the feeding cassette moves from the waiting position to the feeding position.

2. The image forming apparatus according to claim 1, further comprising a main feeding unit arranged within the casing to store another printable medium and to supply the another printable medium to the image forming unit.

3. An image forming apparatus comprising:

an image forming unit to form an image on a printable medium;

a feeding cassette arranged so as to move between a feeding position to store a stack of printable media and a waiting position where the feeding cassette is folded;

a pick-up roller to feed an individual sheet of printable medium from the feeding cassette to the image forming unit, when the feeding cassette is in the feeding position;

a pick-up roller cover arranged so as to rotate between an open position to expose the pick-up roller and a closed position to cover the pick-up roller, wherein the pick-up roller cover moves from the closed position to the open position as the feeding cassette moves from the waiting position to the feeding position;

a pressing boss provided on one side of the feeding cassette; and a cover rotating switch provided on one side of a casing and interlocked with the pressing boss so as to project and retreat along with a pressing and releasing of the pressing boss and to guide the rotation of the pick-up roller cover between the open position and the closed position when the feeding cassette rotates from the waiting position to the feeding position.

4. The image forming apparatus according to claim 3, wherein the pick-up roller cover further comprises a cover main body and a cover hinge unit rotatably coupling the cover main body to the casing.

5. The image forming apparatus according to claim 4, wherein:

the pick-up roller cover further comprises a guide shaft separated from the cover hinge unit; and the cover rotating switch comprises a guide groove to guide the guide shaft so that the pick roller cover can move from the closed position to the open position according to the projection and retreat of the cover rotating switch.

6. The image forming apparatus according to claim 5, wherein the cover hinge unit comprises an elastic member to provide an elastic force to the guide shaft so that the cover rotating switch can be projected with respect to the casing when the cover rotating switch is released from the pressing boss when the cover rotating switch retreats.

7. An image forming apparatus comprising:

a casing;

an image forming unit within the casing to form an image on a printable medium;

a feeding cassette arranged so as to rotate between a feeding position, opened outward with respect to the casing, to store a stack of printable media and a waiting position where the feeding cassette is folded adjacent to the casing;

a pick-up roller to feed an individual sheet of printable medium from the feeding cassette to the image forming unit, when the feeding cassette is in the feeding position;

a pick-up roller cover arranged so as to rotate between an open position, opened inward with respect to the casing, to expose the pick-up roller and a closed position, adjacent to the casing, to cover the pick-up roller, wherein the pick-up roller cover moves from the closed position to the open position as the feeding cassette moves from the waiting position to the feeding position; and a pressure boss provided on one side of the feeding cassette to press the pick-up roller cover so as to rotate the pick-up roller cover from the closed position to the open position, when the feeding cassette rotates from the waiting position to the feeding position.

8. The image forming apparatus according to claim 7, further comprising a hinge unit rotatably supporting the pick-up roller cover and disposed between the pick-up roller cover and the casing.

9. The image forming apparatus according to claim 8, further comprising an elastic member arranged at the hinge unit to provide an elastic force so that the pick-up roller cover can rotate to the closed position.

10. An image forming apparatus comprising:

a casing;

an image forming unit within the casing to form an image on a printable medium;

a feeding cassette arranged so as to rotate between a feeding position, opened outward with respect to the casing, to store a stack of printable media and a waiting position where the feeding cassette is folded adjacent to the casing;

a pick-up roller to feed an individual sheet of printable medium from the feeding cassette to the image forming unit, when the feeding cassette is in the feeding position; and a pick-up roller cover arranged so as to rotate between an open position, opened inward with respect to the casing, to expose the pick-up roller and a closed position, adjacent to the casing, to cover the pick-up roller, wherein the pick-up roller cover moves from the closed position to the open position as the feeding cassette moves from the waiting position to the feeding position, wherein:

the pick-up roller cover comprises a first inclined surface inclined at a predetermined angle in a lower part of the pick-up roller cover, and the pick-up roller cover is coupled to the casing so as to move up or down between the closed position and the open position; and the feeding cassette comprises an ascending and descending link having a second inclined surface corresponding to the first inclined surface, the ascending and descending link rotating with respect to the feeding cassette along with the rotation of the feeding cassette and pressing the pick-up roller cover so that the pick-up roller cover moves up or down.

11. The image forming apparatus according to claim 10, wherein:

the casing comprises an accommodating unit to accommodate the pick-up roller cover in the open position, and the accommodating unit comprises an ascending and descending guide rail to slidingly guide the pick-up roller cover according with pressing by the ascending and descending link.

12. An image forming apparatus comprising:

a casing;

an image forming unit inside the casing to form an image onto a printable medium;

a feeding cassette coupled to the casing and arranged so as to rotate between a feeding position to store a stack of printable media and a waiting position where the feeding cassette is folded;

a pick-up roller to feed the printable medium from the feeding cassette to the image forming unit;

a pick-up roller cover coupled to the casing to move between an open position to expose the pick-up roller to the outside so as to allow the pick-up roller to feed the printable medium from the feeding cassette to the image forming unit and a closed position to cover the pick-up roller so as to prevent contamination of the pick-up roller; and a connector to interlock the pick-up roller cover to the feeding cassette, wherein the pick-up roller cover moves from the closed position to the open position while interlocking with the movement of the waiting position to the feeding position, so that the pick-up roller cover and the feeding cassette are on different sides of the casing.

13. The image forming apparatus according to claim 12, further comprising a main feeding unit arranged within the casing to store another printable medium and to supply the another printable medium to the image forming unit.

14. An image forming apparatus comprising:

a casing;

an image forming unit inside the casing to form an image onto a printable medium;

a feeding cassette coupled to the casing and arranged so as to rotate between a feeding position to store a stack of printable media and a waiting position where the feeding cassette is folded;

a pick-up roller to feed the printable medium from the feeding cassette to the image forming unit;

a pick-up roller cover coupled to the casing to move between an open position to expose the pick-up roller to the outside so as to allow the pick-up roller to feed the printable medium from the feeding cassette to the image forming unit and a closed position to cover the pick-up roller so as to prevent contamination of the pick-up roller, wherein the pick-up roller cover moves from the closed position to the open position while interlocking with the movement of the waiting position to the feeding position;

a pressure boss coupled to one side of the feeding cassette; and a cover rotating switch coupled to the casing so as to correspond to the pressure boss, the cover rotating switch controlling the rotation of the pick-up roller cover between the open position and the closed position;

wherein the pressure boss applies pressure to the cover rotating switch while the feeding cassette is rotating to the feeding position so as to cause the cover rotating switch to rotate the pick-up roller cover to the open position.

15. An image forming apparatus comprising:

a casing;

an image forming unit inside the casing to form an image onto a printable medium;

a feeding cassette coupled to the casing and arranged so as to rotate between a feeding position to store a stack of printable media and a waiting position where the feeding cassette is folded;

a pick-up roller to feed the printable medium from the feeding cassette to the image forming unit; and a pick-up roller cover coupled to the casing to move between an open position to expose the pick-up roller to the outside so as to allow the pick-up roller to feed the printable medium from the feeding cassette to the image forming unit and a closed position to cover the pick-up roller so as to prevent contamination of the pick-up roller, wherein the pick-up roller cover moves from the closed position to the open position while interlocking with the movement of the waiting position to the feeding position, so that the pick-up roller cover and the feeding cassette are on different sides of the casing, and the feeding cassette comprises:

a feeding cassette main body to store the printable medium; and an elastic pressure part coupled to the feeding cassette and arranged so as to push the pick-up roller cover to the open position when the feeding cassette moves from the waiting position to the feeding position.

16. The image forming apparatus according to claim 15, wherein:

an end of the elastic pressure part that comes into contact with the pick-up roller cover has an inclined surface;

an end of the pick-up roller cover that comes into contact with the elastic pressure part has an inclined surface; and the pick-up roller cover moves vertically from the closed position to the open position when being pushed by the elastic pressure part.

17. An image forming apparatus comprising:

a casing;

an image forming unit inside the casing to form an image onto a printable medium;

a feeding cassette coupled to the casing and arranged so as to rotate between a feeding position to store a stack of printable media and a waiting position where the feeding cassette is folded;

a pick-up roller to feed the printable medium from the feeding cassette to the image forming unit;

a pick-up roller cover coupled to the casing to move between an open position to expose the pick-up roller to the outside so as to allow the pick-up roller to feed the printable medium from the feeding cassette to the image forming unit and a closed position to cover the pick-up roller so as to prevent contamination of the pick-up roller, wherein the pick-up roller cover moves from the closed position to the open position while interlocking with the movement of the waiting position to the feeding position, wherein the feeding cassette comprises:

a feeding cassette main body to store the printable medium, and an elastic pressure part coupled to the feeding cassette and arranged so as to push the pick-up roller cover to the open position when the feeding cassette moves from the waiting position to the feeding position; and a torsion spring coupled to the elastic pressure part so as to cause the elastic pressure part to rotate to push the pick-up roller cover.

18. An image forming apparatus, comprising:

an image forming part which forms an image on a printing-medium;

a casing which accommodates the image forming part;

a feeding cassette which is provided movably between a feeding position where the feeding cassette is separated from the casing and used for feeding the printing-medium to an inside of the casing and a waiting position where the feeding cassette is coupled to the casing;

a sub feeding cassette which is accommodated in the casing and receives the printing medium from the feeding cassette;

a pick-up roller which feeds the printing-medium from the feeding cassette to the image forming part in the feeding position;

a pick-up roller cover which is movably coupled to the casing and moves between an opening position for exposing the pick-up roller to the outside so that the printing-medium from the feeding cassette in the feeding position can be in contact with the pick-up roller and picked up to the image forming part and a closing position for preventing contact between the pick-up roller and the printing medium when the feeding cassette is in the waiting position; and a connector to connect the pick-up roller cover to the feeding cassette, the pick-up roller cover moving from the closing position to the opening position in cooperation with the movement of the feeding cassette from the waiting position to the feeding position, so that the pick-up roller cover and the feeding cassette are on different sides of the casing.

19. The image forming apparatus according to claim 18, wherein the pick-up roller cover and the feeding cassette are entirely on different sides of the casing.

20. The image forming apparatus according to claim 18, wherein the sub feeding cassette comprises a sub pick-up roller cover, and the connector comprises an elastic pressure part which is provided on opposite end sides of a main body of the sub feeding cassette and is elastically rotated according to the rotation of a main body of the sub feeding cassette and pushes the sub pick-up roller cover.

21. The image forming apparatus according to claim 20, wherein the elastic pressure part comprises:

a coupling shaft rotatably coupled to the feeding cassette, and a torsion spring on the coupling shaft to supply an elastic force to the coupling shaft so that the elastic pressure part rotates to push the pick-up roller cover when the feeding cassette rotates.

* * * * *

UNITED STATES PATENT AND TRADEMARK OFFICE

CERTIFICATE OF CORRECTION

PATENT NO. : 8,033,540 B2
APPLICATION NO. : 11/874457
DATED : October 11, 2011
INVENTOR(S) : Jin-Soo Lee et al.

It is certified that error appears in the above-identified patent and that said Letters Patent is hereby corrected as shown below:

Column 11, Line 4, In Claim 5, delete "pick" and insert -- pick-up --, therefor.

Signed and Sealed this
Fourteenth Day of February, 2012

David J. Kappos

David J. Kappos
*Director of the United States Patent and Trademark Office*